US005435695A

United States Patent [19]

Chiu et al.

[11] Patent Number: 5,435,695

[45] Date of Patent: Jul. 25, 1995

[54] MULTI-POSITIONABLE FAN

[75] Inventors: Bernard Chiu, Wellesley, Mass.; Robert L. Marvin, Jr., Farmington, Conn.; John Longan, North Uxbridge, Mass.

[73] Assignee: Duracraft Corp., Sudbury, Mass.

[21] Appl. No.: 111,357

[22] Filed: Aug. 24, 1993

[51] Int. Cl.[6] ..... F03B 11/02

[52] U.S. Cl. ..... 416/244 R; 416/247 R

[58] Field of Search ..... 416/244 R, 246, 247 R; 248/653, 652

[56] References Cited

U.S. PATENT DOCUMENTS

| | | | |
|---|---|---|---|
| D. 144,034 | 3/1946 | Budlong | 416/247 R |
| 2,215,035 | 10/1940 | Gundelfinger | 416/247 R |
| 2,618,435 | 11/1952 | Koch | 416/247 R |
| 2,862,657 | 12/1958 | Copeland et al. | 416/247 R |
| 3,347,452 | 10/1967 | Radcliffe | 416/247 R |
| 5,292,088 | 3/1994 | Lemont | 416/247 R |
| 5,295,811 | 3/1994 | Chiu | 416/247 R |
| 5,304,040 | 4/1994 | Wang | 416/246 |

FOREIGN PATENT DOCUMENTS

| | | | |
|---|---|---|---|
| 0126293 | 6/1987 | Japan | 416/246 |
| 0210291 | 10/1987 | Japan | 416/246 |

*Primary Examiner*—Edward K. Look
*Assistant Examiner*—Mark Sgantzos
*Attorney, Agent, or Firm*—Pennie & Edmonds

[57] ABSTRACT

A portable electric fan with fixed multiple support structure permitting orientation of the fan in various angular positions with respect to the support surface on which the fan is placed.

7 Claims, 12 Drawing Sheets

MULTI-POSITIONABLE FAN

FIELD OF THE INVENTION

The invention relates to an air blower, such as a portable fan, capable of being disposed in various positions.

BACKGROUND OF THE INVENTION

Portable electric fans are used to create an air-flow pattern within a particular area, such as a room. Often, it is desirable to be able to position the fan to direct the air flow in different directions. Many portable fans are constructed with adjustable supports which can be set to effect this result. Typically, moving parts are required to adjust the positioning of the fan. This, in turn, complicates and increases the expense of manufacture of the fan.

SUMMARY OF THE INVENTION

The present invention relates to an air blower such as a portable electric fan in which the support structure is fixed to the fan housing in such a way as to permit orientation of the fan in various angular positions with respect to the support surface on which the fan is placed. More particularly, the fan housing has a front circular shape and a side surface which tapers rearwardly from the front. A plurality of projections in the form of support members are secured to the side surface at circumferentially spaced positions around the side surface. These support members are configured so that any two of them in conjunction with the outer periphery of the front of the fan housing will be used to support the fan on an underlying surface. By rotating the fan housing to use different pairs of support members in conjunction with the front periphery of the housing, the longitudinal axis of the fan with respect to the support surface can be adjusted to thereby adjust the direction of flow of the fan. In addition, the support members are so configured that by placing the fan with the longitudinal axis extending upwardly, the support members will orient the longitudinal axis slightly at an angle relative to the perpendicular axis extending from the surface on which the fan is placed.

BRIEF DESCRIPTION OF THE DRAWINGS

The invention will be more fully understood with reference being made to the accompanying drawings which are computer assisted design (CAD) drawings and are to be relied upon as engineering scaled drawings for completing the disclosure of the present invention.

DETAILED DESCRIPTION OF THE INVENTION

Figure 1:
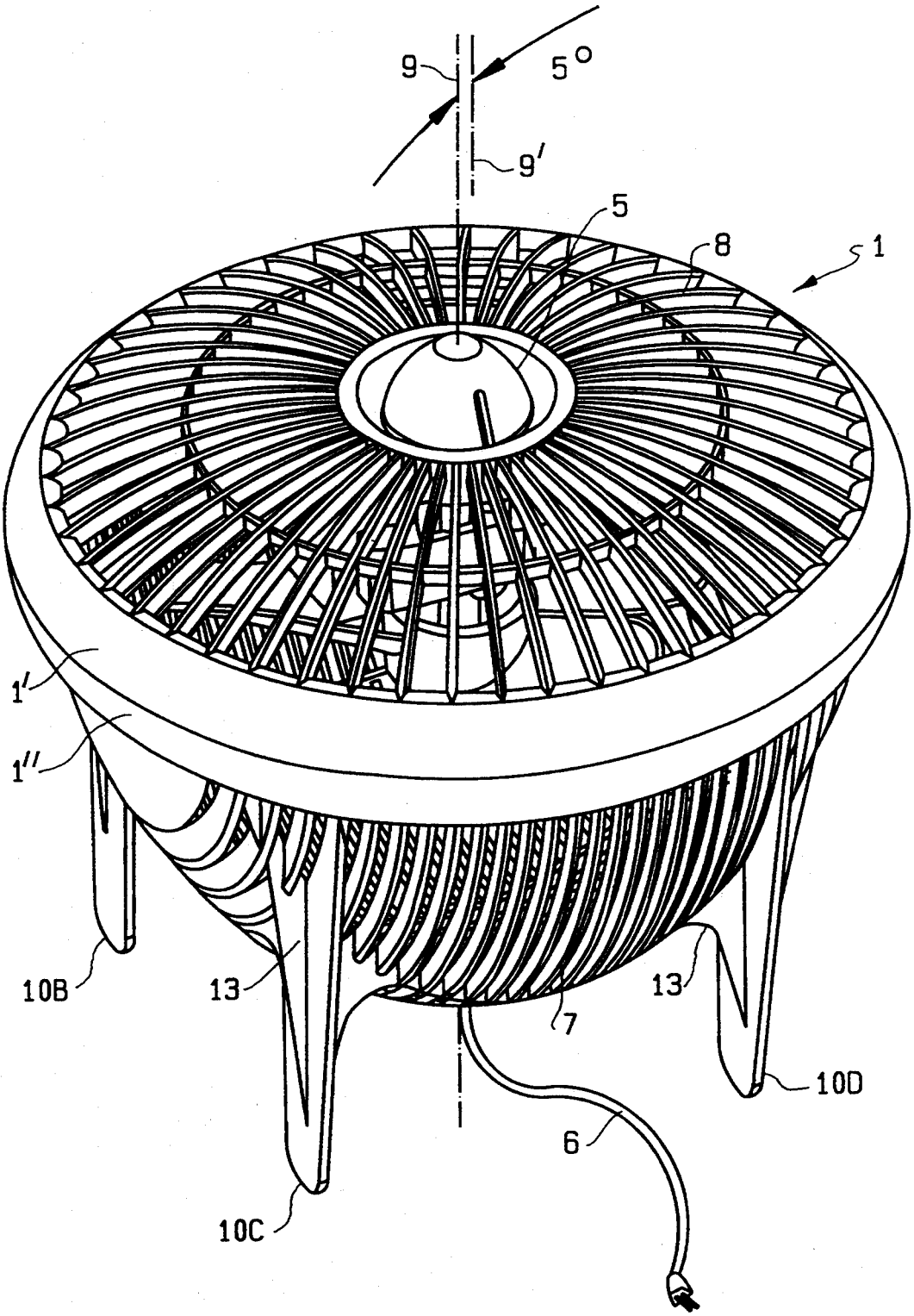
FIG. 1 is a perspective view of the fan constructed according to the present invention.

The fan is comprised of a housing 1 having a front part 1' and a rear part 1'', a motor 2, a fan blade 3, a switch 4, a switch knob 5 and a power cord 6. The housing encloses the motor and the fan blade, and is constructed so as to include an intake grill 7 upstream of the fan blade and an exhaust grill 8 downstream of the fan blade. Air moved by the blade will enter through the intake grill and be forced out substantially straight from the exhaust grill along the direction of the fan's longitudinal axis 9.

The fan housing also includes four projections in the form of support members 10A–10D adjacent to the intake grill and external of the housing. These support members act as feet to support the fan in various positions, with different pairs of the support members used for different angular positions of inclination.

Figure 6:
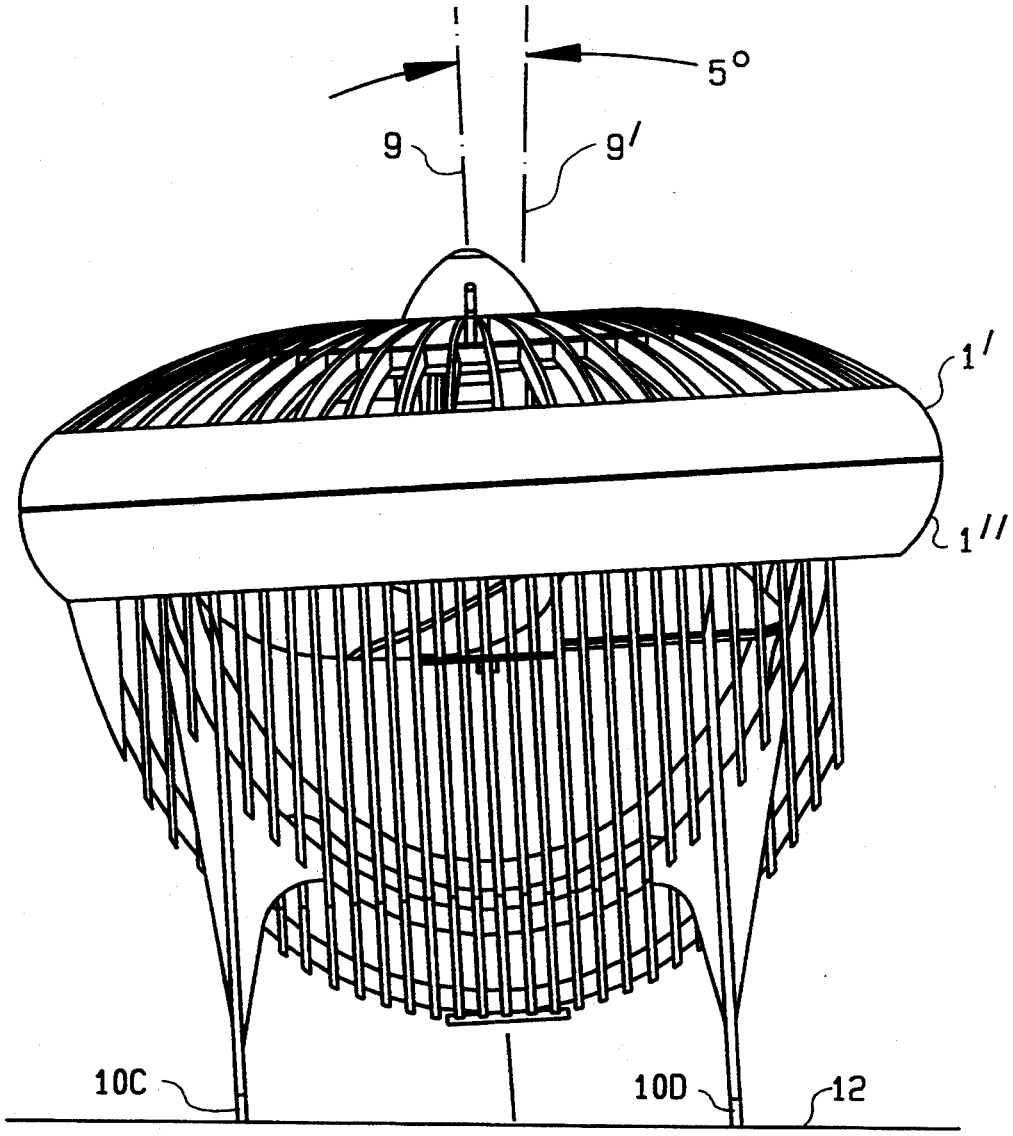
FIG. 6 is a side view of the fan in an upright position.
Figure 7:
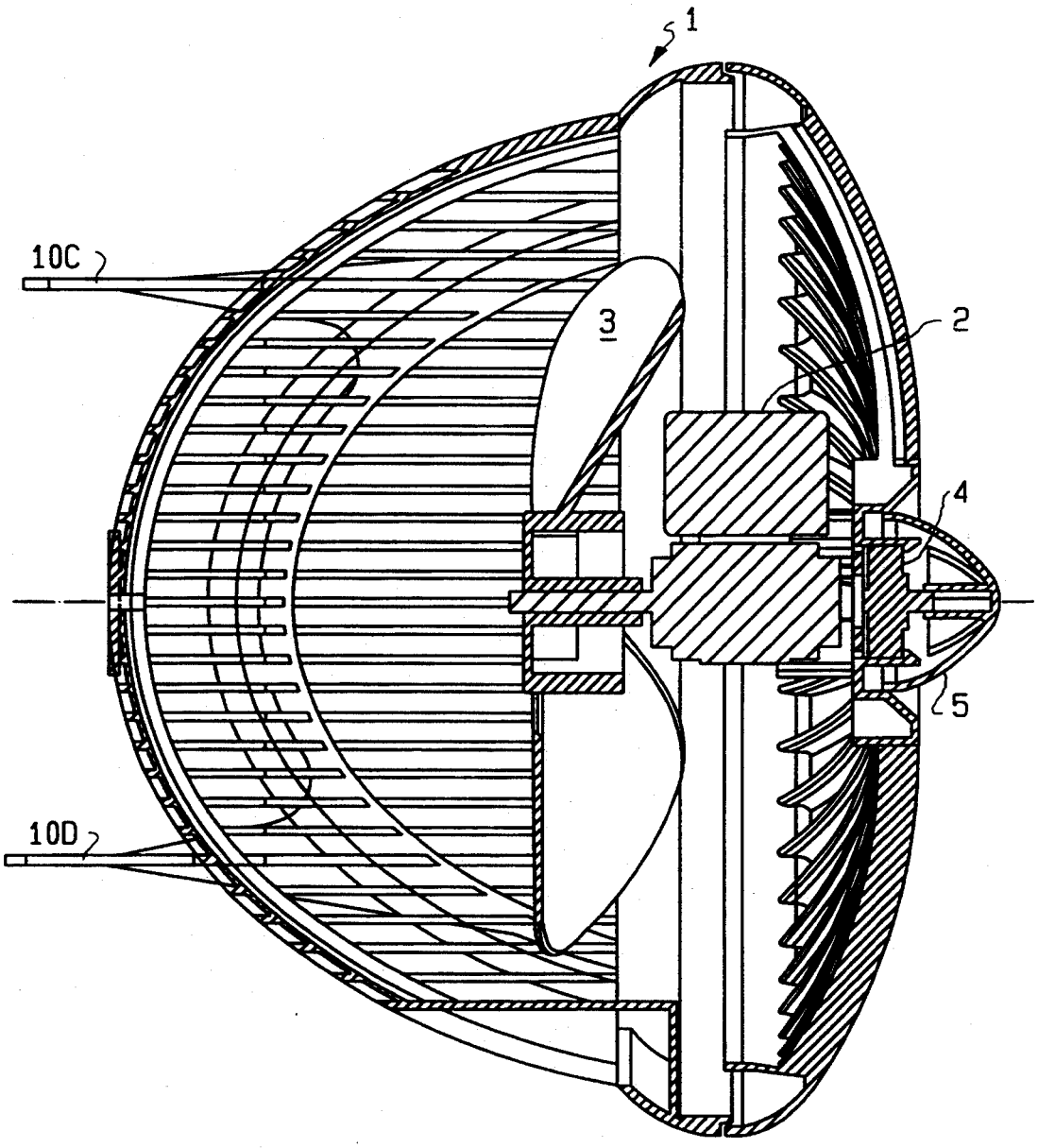
FIG. 7 is a side cross-sectional view of the fan.
Figure 8:
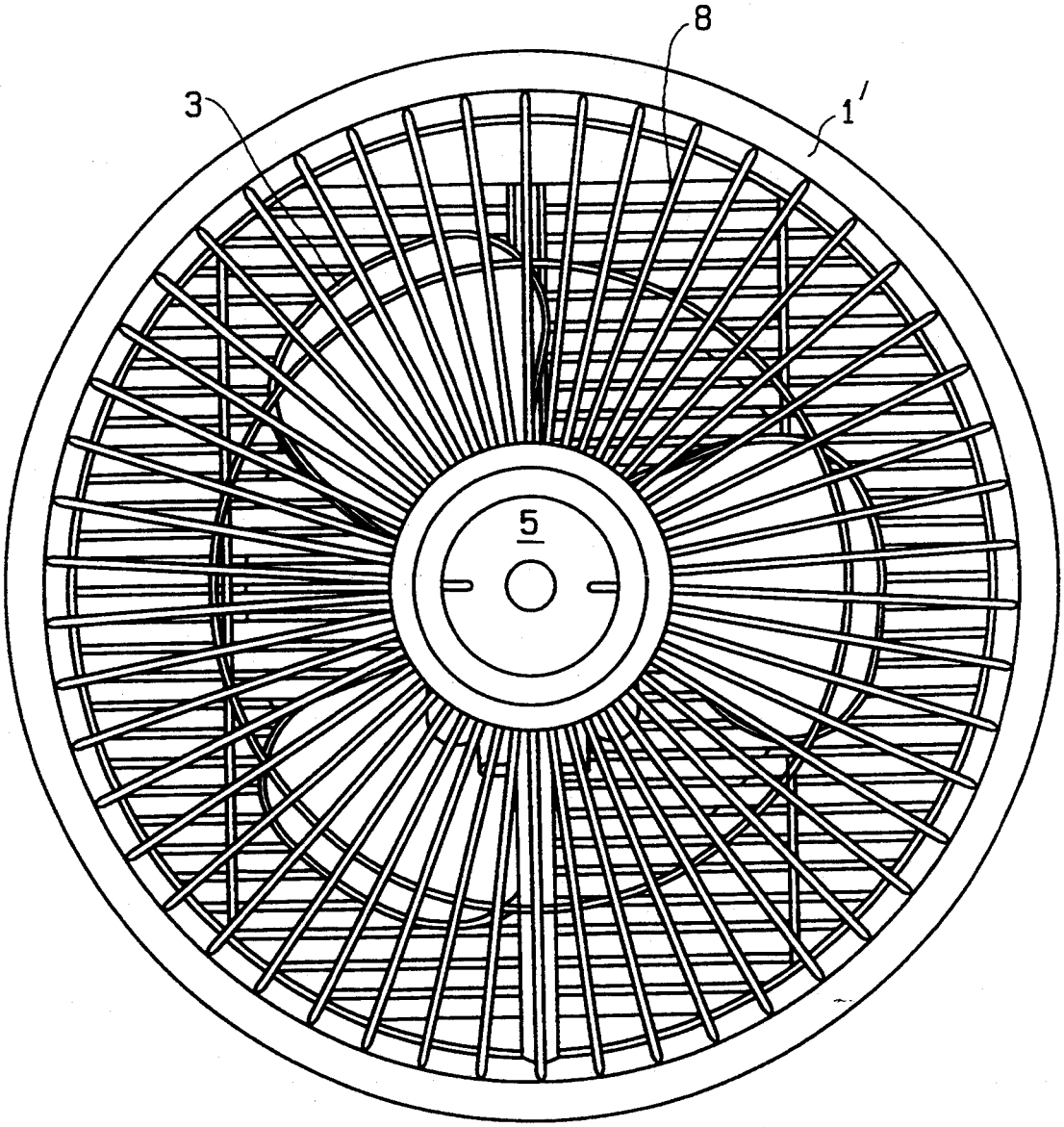
FIG. 8 is a front view of the fan.

In the position shown in FIGS. 1 and 6, all four support members are used as feet to aim the airflow upwards in a substantially vertical direction. The longitudinal axis a of the fan and the output of the fan as it is depicted in FIG. 1 would flow in a direction approximately 5° from vertical, as shown at 9'.

Figure 2:
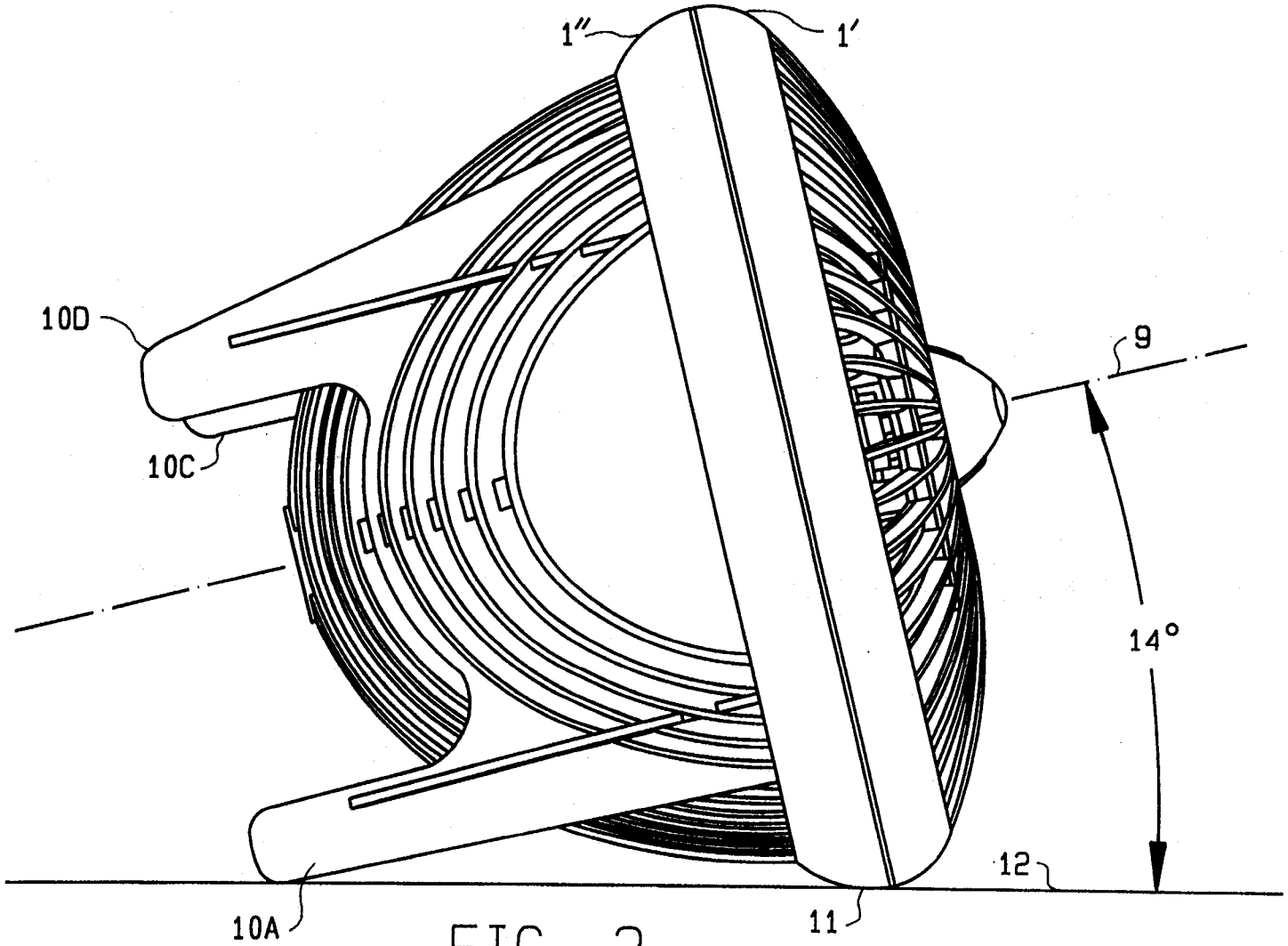
FIG. 2 is a side view of the fan placed in a first side position.

In the position shown in FIG. 2, the fan is tipped such that the outermost periphery 11 of the front of the fan and the support members 10A and 10B are used as feet. In this position, the longitudinal axis 9 of the fan is disposed at 14° from the horizontal support surface 12 on which the fan is placed and the fan output flow is in a direction approximately 14° from the horizontal.

Figure 3:
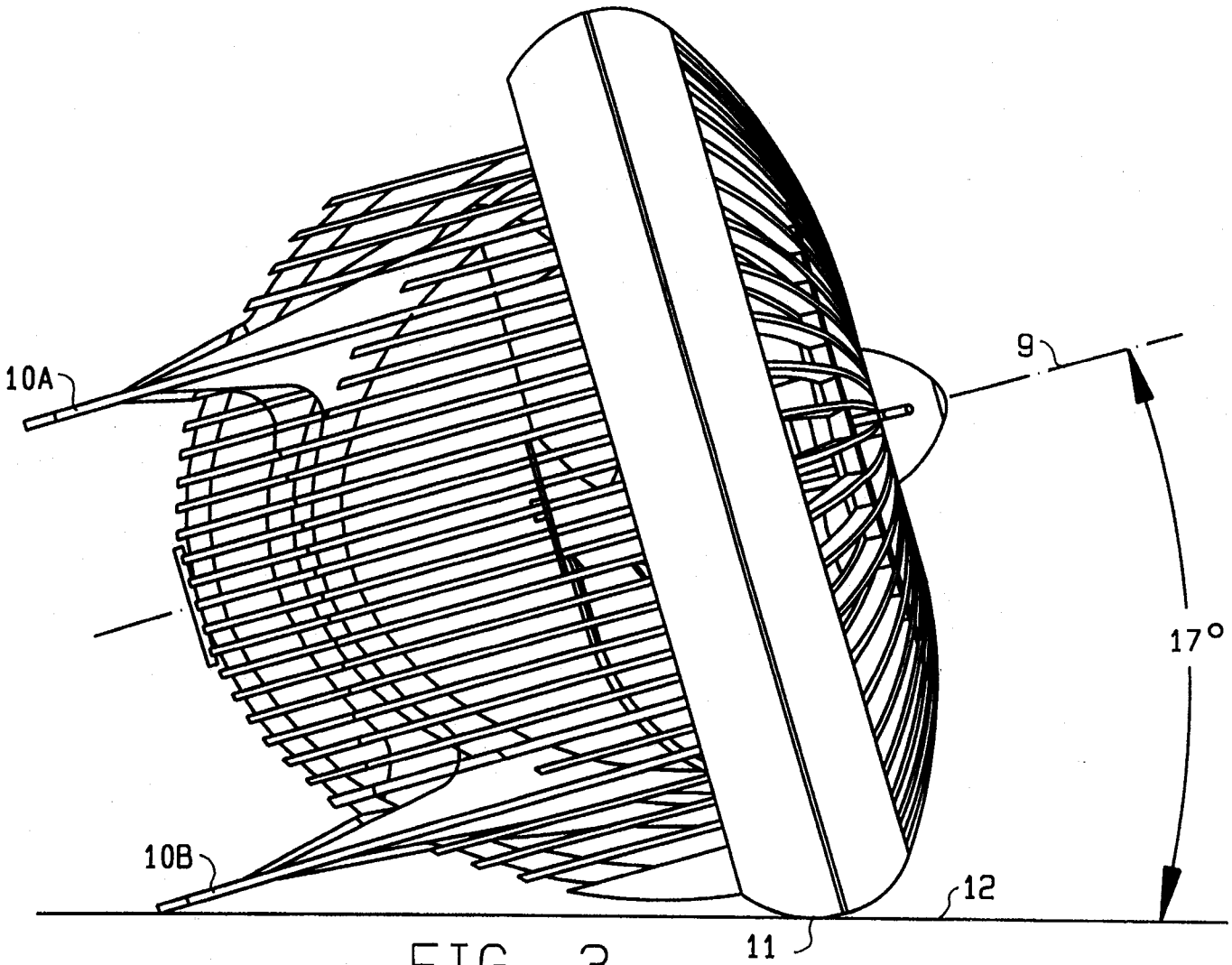
FIG. 3 is a side view of the fan placed in a second side position.

In the position shown in FIG. 3, the fan is tipped such that the outermost periphery 11 and the support members 10B and 10C are used as feet. In this position, the longitudinal axis 9 and the output flow would be in a direction approximately 17° from the horizontal.

Figure 4:
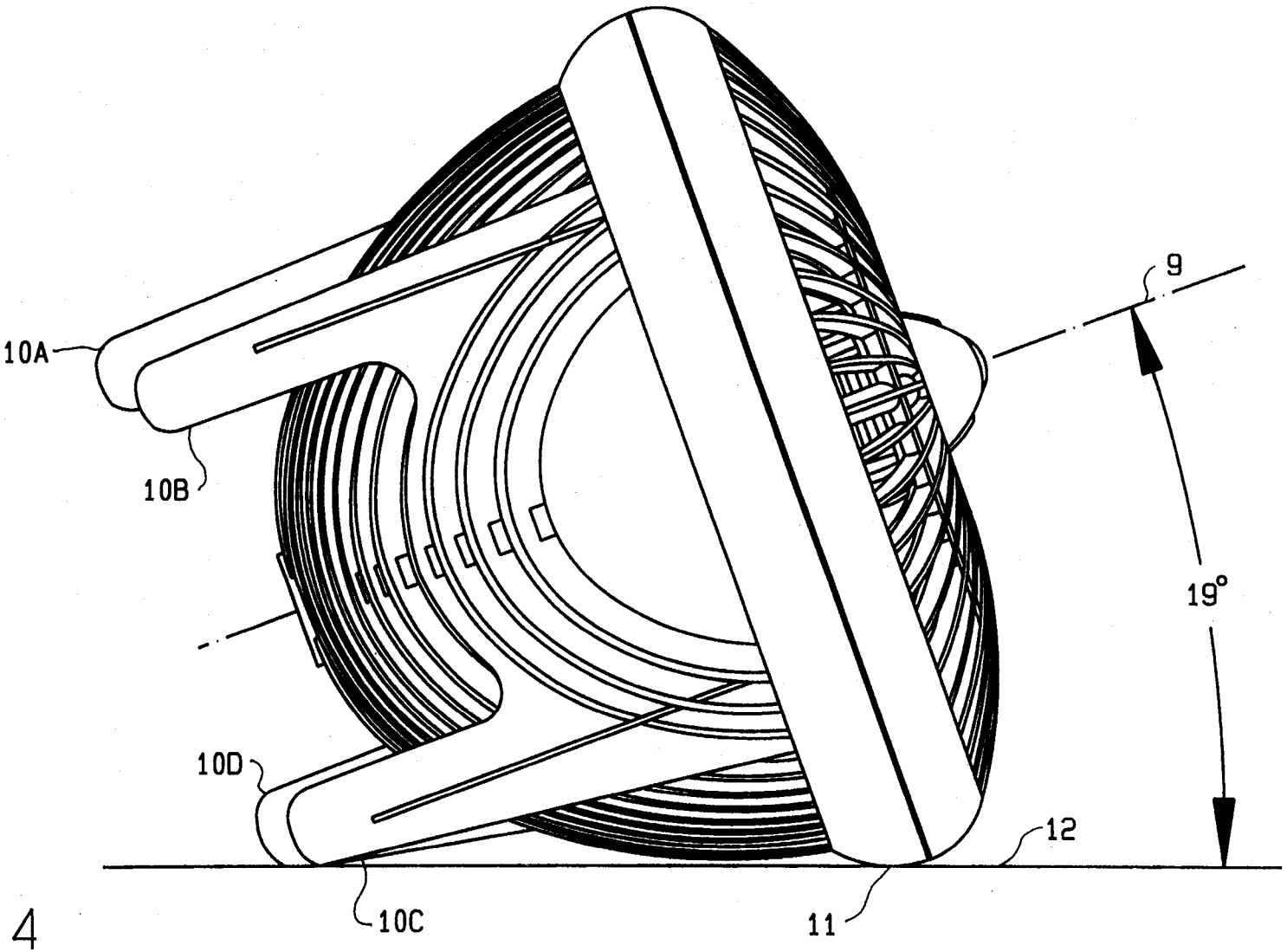
FIG. 4 is a side view of the fan placed in a third side position.

In the position shown in FIG. 4, the fan is tipped such that the outermost periphery and support members 10C and 10D are used as feet. In this position, the longitudinal axis 9 and the output flow would be in a direction approximately 19° from the horizontal.

Figure 5:
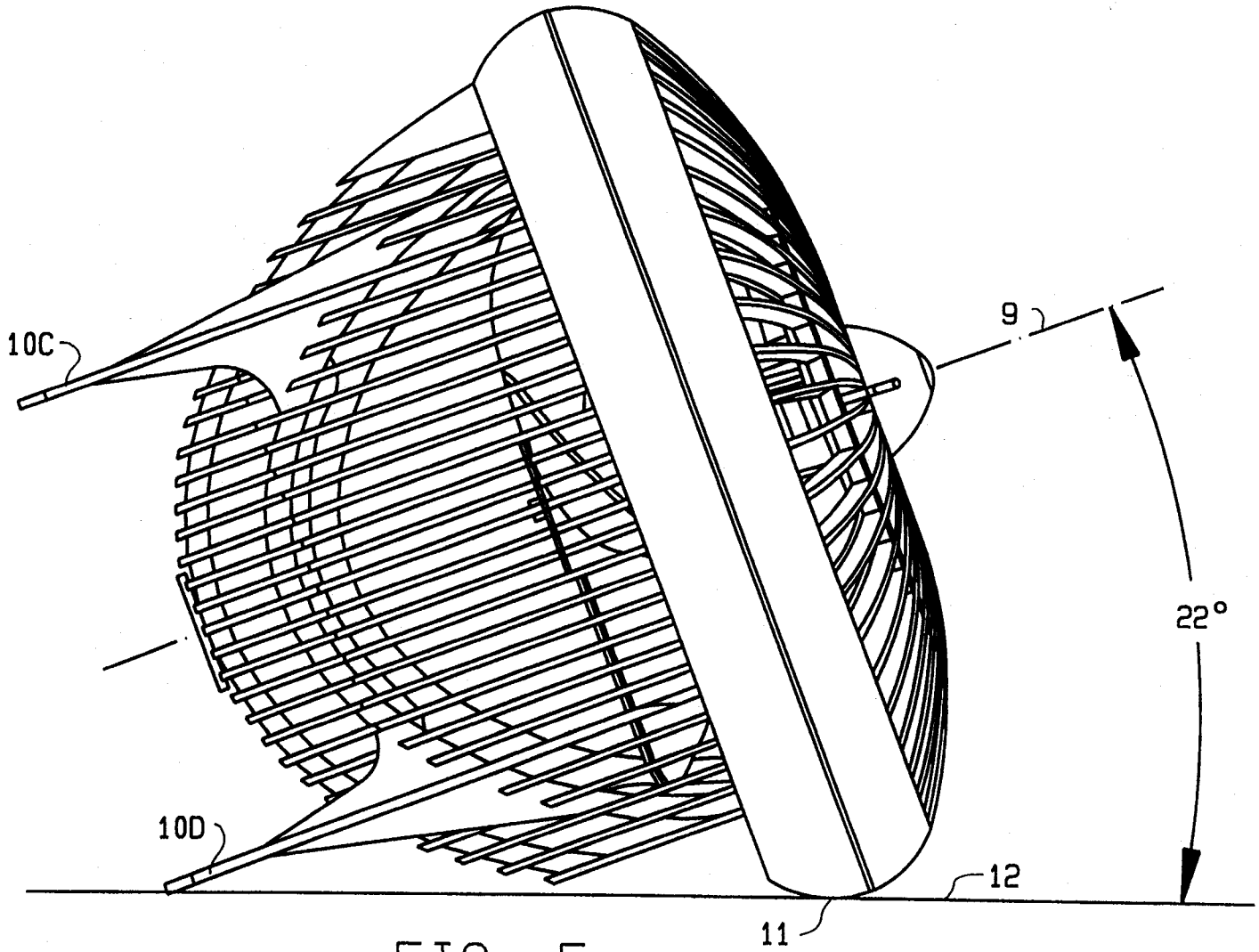
FIG. 5 is a side view of the fan placed in a fourth side position.

In the position shown in FIG. 5, the fan is tipped such that the outermost periphery and support members 10D and 10A are used as feet. In this position, the longitudinal axis 9 and the output flow would be in a direction approximately 22° from the horizontal.

Figure 9:
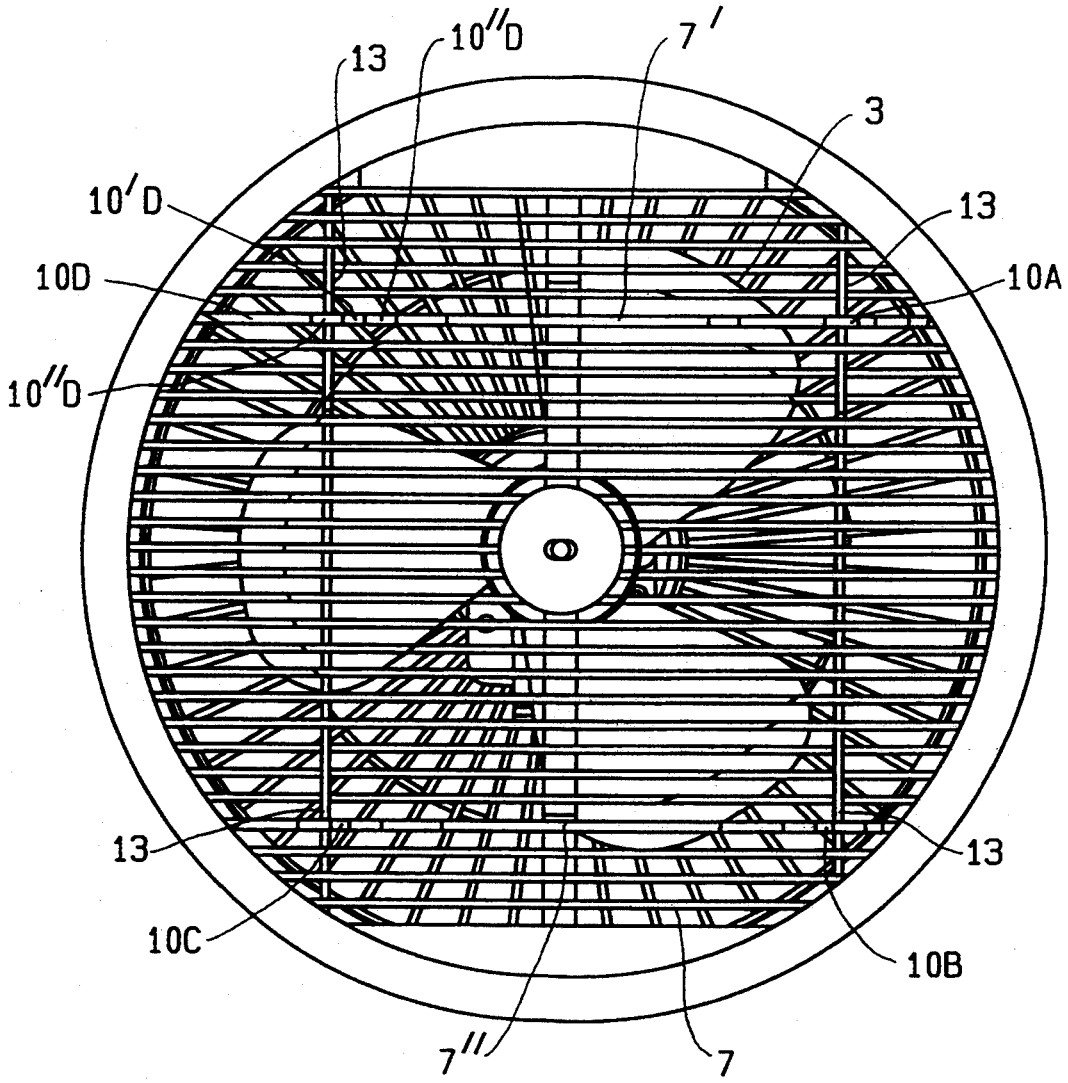
FIG. 9 is a rear view of the fan.

As shown in FIG. 9, the support members 10A–10D are formed integrally as part of two individual grill members 7' and 7''. They are also the same thickness as the individual grill members. Thus, in the side positions shown in FIGS. 2 and 4, the edges of the support members rest on the support surface 12, while in the side positions shown in FIGS. 3 and 5, the sides of the support members rest on the surface 12.

In order to provide additional structure and strength to the support members, side reinforcing members 13 are provided. These side members are most clearly shown in FIG. 1. Also, as shown in FIG. 9, the side reinforcing members 13 extend at right angles to the associated support members 10A–10D.

In the particular embodiment of the invention shown in the drawings, each of the support members has a terminal end surface which is flat with curved corners.

Figure 10:
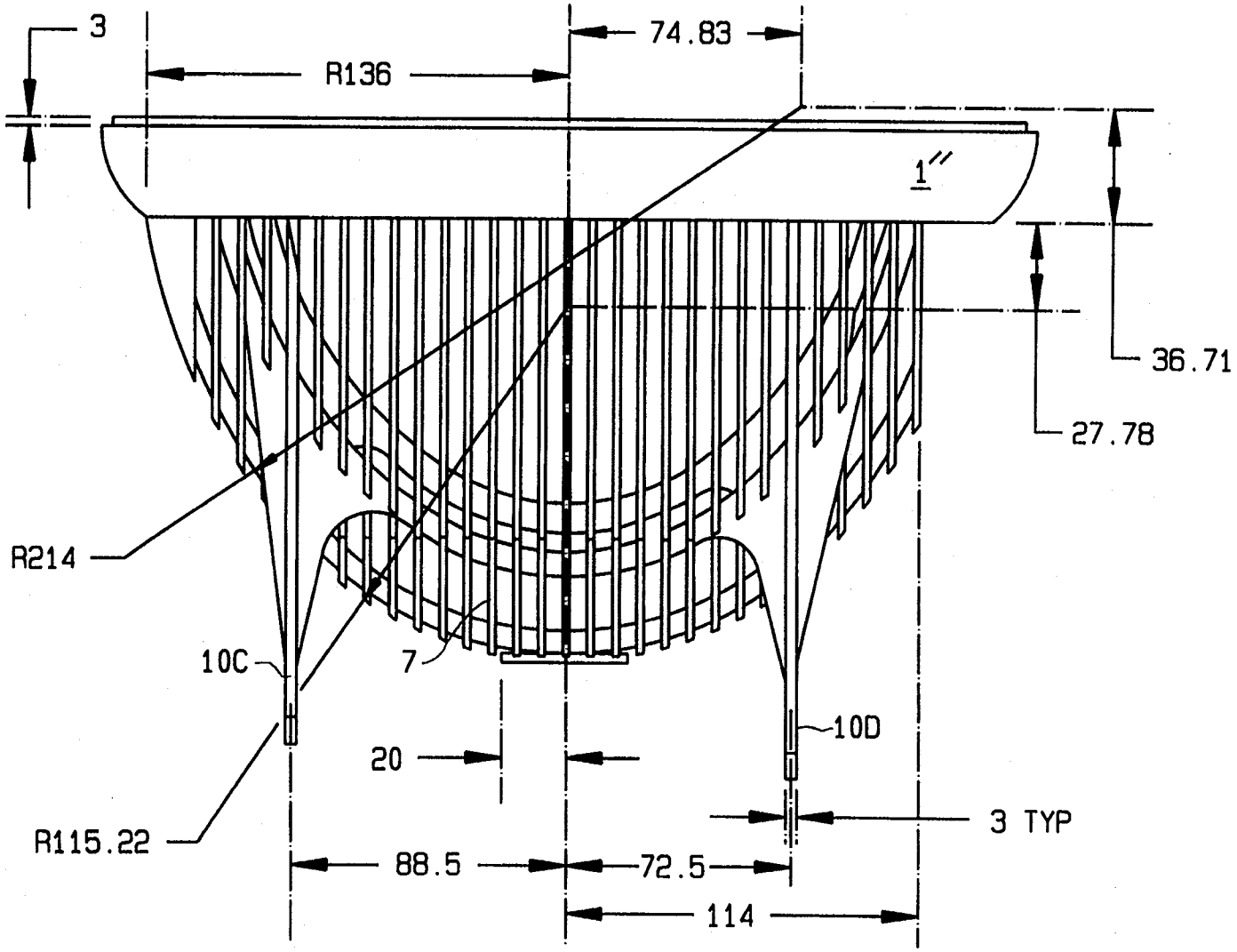
FIG. 10 is a side view of the rear housing part of the fan.
Figure 11:
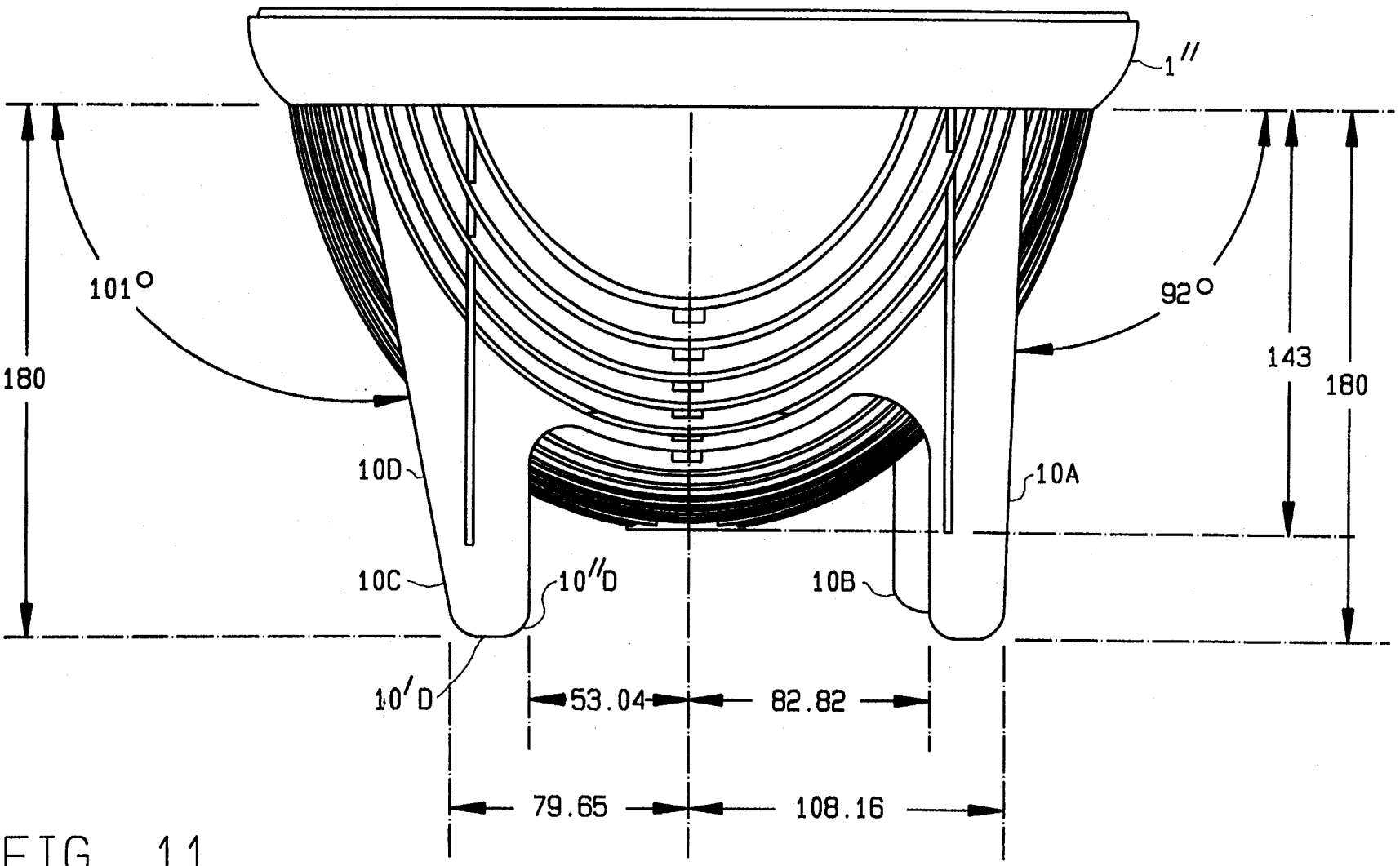
FIG. 11 is another side view of the rear housing part taken at 90° with respect to FIG. 10.
Figure 12:
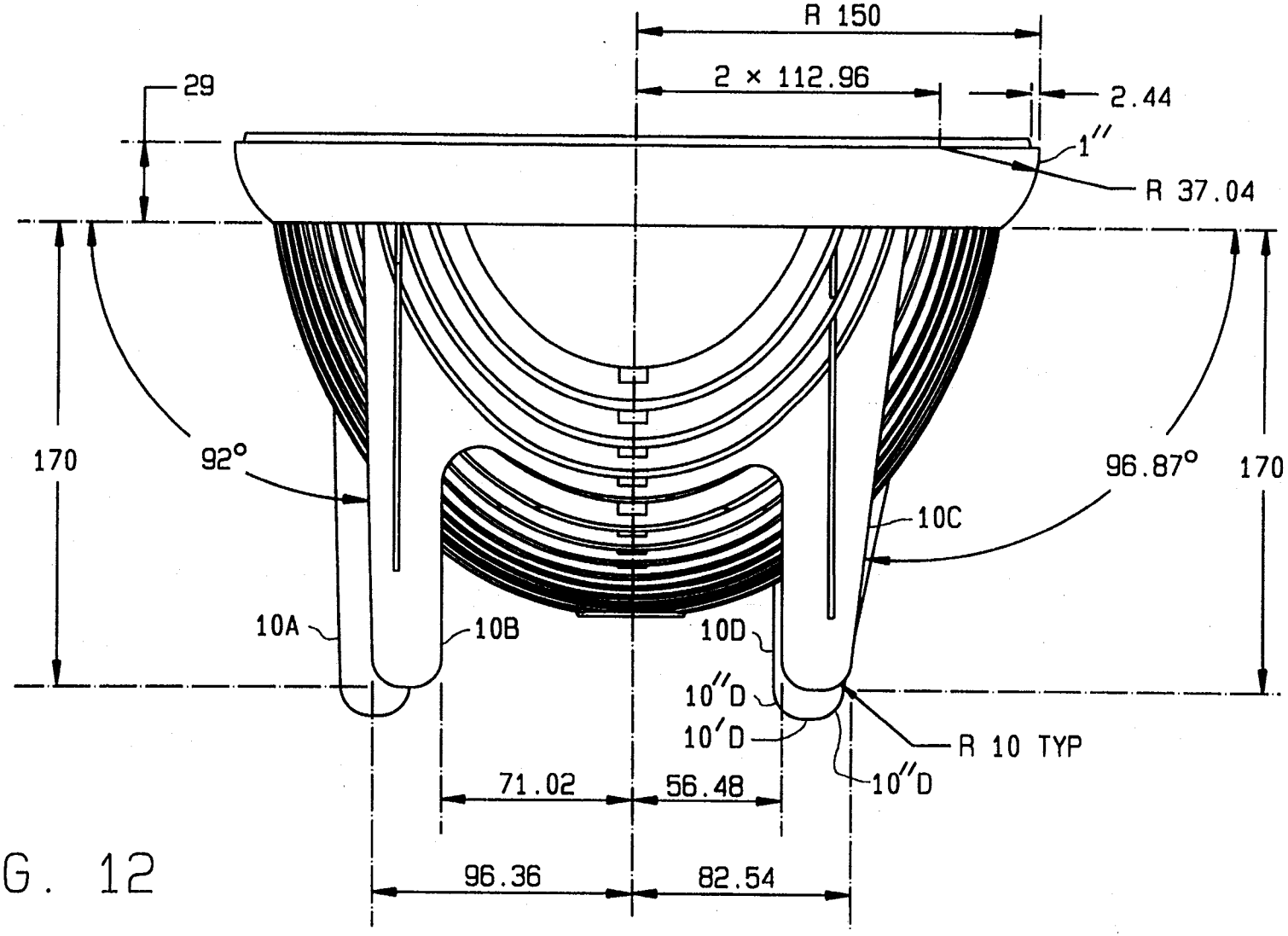
FIG. 12 is a side view of the rear housing part taken at 180° from FIG. 11.

In FIGS. 9, 11 and 12 the flat end surface of the support member 10D is shown at 10'D whereas the curved portions to either side of the flat end surface are shown at 10''D. The other support members are shown in FIG. 9 in the same way as support members 10D and the dimensions of the parts in millimeters are shown in FIGS. 10–12.

In the presently preferred embodiment of the present invention as shown in the drawings, there are four support members 10A–10D. In order to create the angles of inclination for the various side positions as shown in FIGS. 2–5, the support members are constructed so that the ends of any two adjacent support members and the outermost periphery 11 of the front of the fan when contacting the support surface 12 lie in a plane which extends at an angle to the longitudinal axis 9 of the fan that is equal to the desired angle of inclination of the side position of the fan with respect to the horizontal. The different support members are modified in length, width or angle or in some other way so that any two adjacent pairs of support members when acting together with the outer periphery 11 of the fan lie in different planes so as to create the different angles of inclination shown in FIGS. 2–5. Also, it is possible to vary these angles of inclination by varying the spacing of the support members from each other and from the center longitudinal axis 9 of the fan.

Alternate embodiments of this invention may include any appropriate number of similar projections or support members (X) such that by positioning the fan either substantially vertically or tipping it to rest on two adjacent support members, a larger number (X+1) of potential positions would be possible (provided X is more than two).

We claim:

1. A fan comprising:

a) a housing having a front, a rear, a longitudinal axis extending between said front and rear and a front outermost periphery extending around the housing and lying in a plane extending at an angle to said longitudinal axis;

b) fan blade and motor disposed within said housing and positioned so as to direct air outwardly of the housing and through the front thereof;

c) a plurality of support members defining a plurality of adjacent pairs of said support members disposed at circumferentially spaced locations on the rear of the housing for supporting the fan at different angles of inclination on a support surface;

d) each support member of each adjacent pair of support members having a support engaging surface for engagement with said support surface when the fan is positioned with the outermost periphery of the front of the fan on said support surface, and with the engaging surface of each support member of one pair of said adjacent pairs of support members and the outermost periphery lying in a plane disposed at a first angle to the longitudinal axis of the fan equal to one of said angles of inclination; and e) the support members of each other adjacent pair of support members having support engaging surfaces which together with said outermost periphery lie in a plane disposed at different angles to the longitudinal axis of the fan equal to each of the other angles of inclination.

2. A fan according to claim 1 wherein:

a) the support members extend in a direction away from the front of the fan and terminate in end surfaces for supporting the fan, independently of the outermost periphery, on said support surface, with the longitudinal axis of the fan extending generally perpendicular to said support surface.

3. A fan according to claim 2 wherein:

a) four support members are disposed on the rear of the fan.

4. A fan according to claim 3 wherein:

a) the rear of the fan includes spaced grill members lying in different planes relative to each other; and b) each of said support members lies in the plane of a grill member.

5. A fan according to claim 4 wherein:

a) the grill members lie in parallel planes extending parallel to the longitudinal axis of the fan.

6. A fan comprising:

a) a housing having a front, a rear, a longitudinal axis extending between said front and rear;

b) fan blade and motor disposed, at least in part, within said housing and positioned so as to direct air outwardly of the housing and through the front thereof;

c) a plurality of support members disposed at circumferentially spaced locations on the rear of the housing for supporting the fan;

d) the rear of the fan including spaced grill members lying in different planes relative to each other, and e) each of said support members lying in the plane of a grill member.

7. A fan according to claim 6 wherein:

a) the grill members lie in parallel planes extending parallel to the longitudinal axis of the fan.

* * * * *